US005987936A

United States Patent [19]

Hartman, Jr.

[11] Patent Number: 5,987,936

[45] Date of Patent: Nov. 23, 1999

[54] HINGED SECURING MEMBER

[76] Inventor: Charles William Hartman, Jr., 39 Woodlake Dr., Charlottesville, Va. 22901

[21] Appl. No.: 08/985,396

[22] Filed: Dec. 5, 1997

Related U.S. Application Data

[60] Provisional application No. 60/032,473, Dec. 6, 1996, and provisional application No. 60/052,995, May 27, 1997.

[51] Int. Cl.[6] ..... E05B 73/00

[52] U.S. Cl. ..... 70/2; 70/18; 70/58; 70/164; 70/232; 248/552

[58] Field of Search ..... 70/58, 232, DIG. 57, 70/14, 18, 2, 19, 57, 159, 164; 248/551–553

[56] References Cited

U.S. PATENT DOCUMENTS

| | | | |
|---|---|---|---|
| 490,537 | 1/1893 | Bremer | 70/463 |
| 2,529,432 | 11/1970 | Tenner | 70/19 |
| 3,664,616 | 5/1972 | Raskin | 248/553 |
| 3,673,828 | 7/1972 | Jones | 70/DIG. 57 X |
| 3,945,227 | 3/1976 | Reiland | 70/DIG. 57 X |
| 4,052,867 | 10/1977 | Faunce | 70/DIG. 57 X |
| 4,473,176 | 9/1984 | Harper | 70/58 X |
| 4,556,187 | 12/1985 | McLin | 248/552 X |
| 5,052,198 | 10/1991 | Watts | 70/58 |
| 5,076,079 | 12/1991 | Monoson et al. | 70/58 |
| 5,076,531 | 12/1991 | Delaney | 70/58 X |
| 5,085,395 | 2/1992 | Frater et al. | 70/58 X |
| 5,675,999 | 10/1997 | Carlstrom | 70/58 X |
| 5,839,303 | 11/1998 | Umberg et al. | 70/58 |

FOREIGN PATENT DOCUMENTS

| | | | |
|---|---|---|---|
| 509840 | 2/1955 | Canada | 70/58 |
| 543386 | 9/1922 | France | 70/2 |
| 2643409 | 8/1990 | France | 70/58 |
| 566289 | 12/1944 | United Kingdom | 70/58 |

*Primary Examiner*—Lloyd A. Gall
*Attorney, Agent, or Firm*—Sheldon H. Parker

[57] ABSTRACT

A device is disclosed for securing items, such as boat batteries and gas tanks, against theft and breakage. The locking unit is formed of dual base units, hingeably connected to vertical walls. The base units are connected to a support structure through use of screws or bolts. The top plates are connected to the vertical walls through use of hinges. The top plates can be provided with an adjustable locking member to secure various sized containers. L-shaped plates can be used to prevent any end to end horizontal movement of the container while the locking unit prevents side to side and vertical movement. The base unit can be one or two pieces, depending upon required adjustability. Parallel, opposing, side units, are affixed to the base unit at approximately right angles and a pair of top locking plates are then secured at right angles to the opposite end of the side units. The object is secured within the locking device through use of a lock which secures the top locking plates to one another. The side unit can be chamfered proximate the top locking plates and/or the base unit. A first side unit has a length greater than the second side unit allowing the first locking plate to overlap the second plate. The plates are locked together, through the use of a hasp or similar device, proximate the point of overlap.

16 Claims, 9 Drawing Sheets

HINGED SECURING MEMBER

RELATE BACK

This application is related to provisional applications 60/032,473, filed Dec. 6, 1996 and 60/052,995, filed May 27, 1997.

BACKGROUND OF THE INVENTION

1. Field of the Invention

The invention relates to the field of security devices, and more particularly to the securing of batteries, gas containers, or other rigid objects to a support structure, such as a boat.

2. Brief Description of the Prior Art

Frequently it is beneficial to protect items, which cannot be brought into a safe area, against theft or breakage. Theft protection could include such items as boat batteries and tool boxes. Protection against breakage could include speakers at concerts or parties.

The theft problem is particularly relevant in the boat industry where the batteries are typically externally mounted without significant securing mechanisms. At most, boat batteries are held in place by nylon straps or are stored in water-resistant containers. Boats typically are subject to rocking and extreme movement due to the action of waves and wind on the boat, stretching the plastic straps used due to the movement of the battery in response to the movement of the boat. Sharp blows can cause a battery to have internal shorts, losing its capacity to retain a charge. While this problem is costly, it can produce extreme consequences when it happens in open water.

Another problem is that boats are frequently open and when tied to a dock, the battery and gas tank can easily be stolen. It is therefore desired to both secure boat batteries and gas tanks in place against the motion of the boat, as well as against theft.

A number of other articles, such as gardener's gas cans, can benefit from being secured to a solid structure. At concerts speakers can be stolen or knocked over by enthusiastic crowds. Even sculptures in museums can be stolen or broken if not properly secured. The disclosed locking unit provides an inexpensive method of securing a variety of articles in various sizes and configurations.

SUMMARY OF THE INVENTION

It has now been found that a device can be provided for securing items, such as boat batteries and gas tanks in place, against theft as well as breakage due to motion of a vehicle or bumping by a person.

When used in a boat, or other vehicle, the disclosed invention provides a high level of security as well as easy and convenient removal of either the tank or the battery for charging, refilling, replacement etc.

The securing device can be manufactured from stainless steel, such as type 316. This material will offer great resistance to the corrosive effects of salt water and battery acid, as well as provide the strength for resistance to a thief's attempts to remove the secured items.

In one embodiment, the locking unit is formed of dual base units, hingeably connected to vertical walls. The base units are connected to a support structure, such as a boat, automobile or platform, through use of screws or bolts. The top plates are connected to the vertical walls through use of hinges. The top plates can be provided with adjustable locking means to secure various sized containers. L-shaped plates can be used to prevent any end to end horizontal movement of the container while the locking unit prevents side to side and vertical movement.

The locking device maintains an object in a stationary position within a structure by securing at least one base unit to the structure. The base unit can be one or two pieces, depending upon whether the adjustability provided by the two pieces is required. The base unit can be secured through the use of screws, bolts, etc. Parallel, opposing, side units, are affixed to the base unit at approximately right angles and a pair of top locking plates are then secured at right angles to the opposite end of the side units. The object is secured within the locking device through use of a lock which secures the top locking plates to one another. In one embodiment, the base unit and side units are continuous and hinges are placed between the side units and the top locking plates. The side unit can be chamfered proximate the top locking plates and/or the base unit.

In a second embodiment, hinges are also placed between the side units and the base unit. A pair of opposing L-shaped locking brackets secured to the structure prevent further movement of the object in a second direction, which is 90 degrees from movement prevented by the side units.

In one embodiment, a first side unit has a length greater than the second side unit allowing the first locking plate to overlap the second plate. The plates are locked together proximate the point of overlap. The method of locking the two plates can be through use of a hasp. Multiple receiving areas can be incorporated to provide adjustability to the angle between the side units and base unit.

An alternate locking method uses a rotatable locking arm, connected to a locking flange. The locking flange is at right angles to one of the locking plates. A J-shaped extension arm is rotatably attached to the other end of the locking arm. Both the extension arm and the locking arm are provided with aligned hasp receiving slots. A hasp loop is affixed to the locking plate and positioned to interact with the receiving slots. The unattached end of the extension arm is provided with a locking unit, such as a tab, or loop which interacts with a complementary receiving unit, such as a slot or tab positioned in the other locking plate. To lock the rotatable locking arm, the locking unit is connected to the receiving unit and the extension arm pressed to be parallel with the locking plate. Once in the locked position, the hasp loop extends through locking arm hasp and extension arm receiving slots a sufficient distance to receive a lock.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
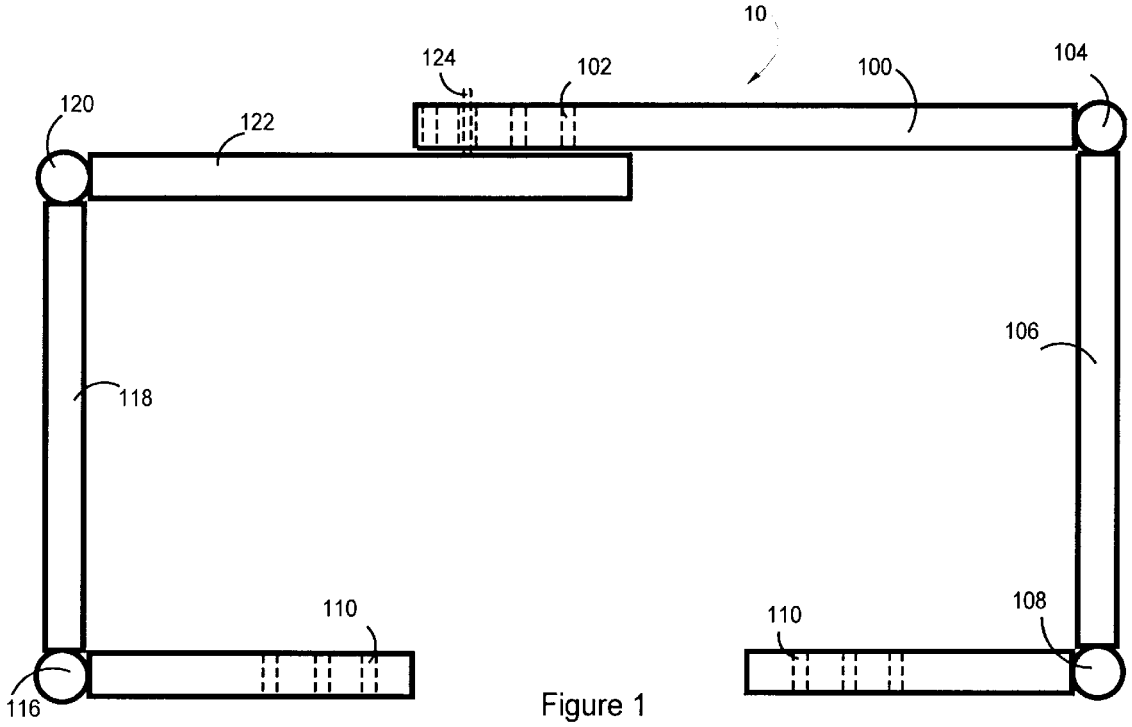
FIG. 1 is a plan view of a securing mechanism in accordance with the present invention.

The boat battery securing device is designed to serve two different functions. The first is to provide a rigid attachment of the battery to the boat and the second is to provide a means of locking the battery to deter theft. As a battery, or portable gas tank, securing means it would replace the currently available devices which are presently available to perform these duties. Currently to secure a battery, one uses either a flexible woven nylon strap with a friction buckle held down by two plastic eyes or, a device made of two threaded rods emerging from a tray and arranged vertically with a horizontal plastic cross bar on top held down by nuts and bolts, as used on automobiles. In the marine environment, 6 or 12 gallon plastic gas tanks are generally carried on most outboard engine powered craft, and are either used unsecured or, at most, secured with a similar nylon strap and friction buckle.

The purpose of the instant invention is designed to provide a secure tie-down and a means to lock the device to prevent theft. Additionally, the security device ensures safety. Both a battery and portable gas tank are potential explosion hazards, especially if they are free to move either due to normal usage or, especially, in an accident situation. Since boats travel at high speeds both on water and, in many cases, on the highway while being trailered, their rapid unpredictable movement may present a significant hazard. In addition, a boat is subject to sudden unpredictable movement due to operator error or wave action. The devices presently available to secure either batteries or gas tanks, such as the nylon strap, lack the strength to retain the device in place. Additionally, nylon straps tend to stretch. More importantly, nylon degrades due to the ultra violet light. Unfortunately, this loss of strength is not visible and therefore periodic visual checking will not indicate a faulty or weak strap.

In addition, none of the currently available securing devices offer the ability to lock either a battery or fuel tank against theft. The structure of the instant invention enables the user to positively lock the battery, or fuel tank, using any commonly available padlock, either keyed or combination type. Since many boats spend most of their lives on trailer, rather than in the water, they are easy targets for thieves who will steal anything which is readily removable. In addition, boats are frequently stored where security is hard to ensure, and are not visited or examined for long periods of time.

The security device disclosed herein consists of four units, which are secured to a boat, or other support structure, to prevent theft of the secured item. The security device can be manufactured in plastic or metal, although the design must be modified accordingly. The security device provides the benefit that the item, whether it is a battery, gas can or storage case, cannot easily be removed from the support structure. For ease of description, the illustration disclosed herein is relating to a battery being secured in a boat. It should be understood, however, that the locking units can secure any rigid item to any support structure. For example, several of the locking units can be used on a boat, one to lock the battery in place, one to secure a gas can and one to secure an empty chest in which to store miscellaneous items which are susceptible to theft. The units can be secured to the trunks of cars, or the beds of pick ups to store tools, etc. The sizing illustrated herein is for a external battery housed in a casing, however, the sizing can be readily changed dependent upon the size of the unit to be secured. An example would be speakers in either the home or public area, such as concert or restaurant. The locking unit would enable the speaker to be secured to a stage, wall or floor. It should also be noted that although the configuration shown herein is rectangular, this can be adapted to the item to be locked in place, especially when using plastic as a manufacturing material.

The battery locking unit should be manufactured from a non-corrosive material, such as stainless steel, for the backing plates, in combination with stainless steel screws or bolts. The L-shaped legs can be aluminum or stainless steel using stainless bolts or screws in combination with washers and nuts. Most advantageously, and particularly where metal members are used, the battery is housed within a plastic or other non-conductive, water resistant container. Although the construction materials can vary, the end use must always be kept in mind. Thus, if the locking unit is to be used on a boat, the materials must be resistant to the harsh elements associated with the ocean. A locking unit intended for use in the trunk of a car would need to remain tamper resistant but would not be exposed to the corrosive elements found on a boat. Plastic coated metal can also be used to provide combination of strength and weather resistance, as well as electrical insulation.

As shown in FIG. 1, the locking unit illustrated generally as 10, includes dual base portions 112 and 114, which are provided with screw holes 110 for attachment to the boat. The first base portion 112 has, at one end, a base hinge 108 which is connected by a pin to the vertical wall 106. The second base portion 114 is connected to the vertical wall 118 through use of hinge 116. The base is divided into dual base units 112 and 114 to allow for adjustability, since in this way, the base units 112 and 114 can be moved to fit the battery width. The base units 112 and 114 are secured by screws, through the countersunk holes 110, to the boat or other support structure. Alternatively, bolts can be used in place of screws, although bolts require accessibility from below the deck or support structure. Whether bolts or screws are used, silicone, or other sealant, should be used to prevent possible leakage and protect against the environment. As the battery or container (not shown) is placed over the dual base portions 112 and 114, it has the effect of concealing the screws. Vertical wall 106 is connected by a hinge 104 to the top plate 100. The hasp plate 122 is connected to vertical wall 118 through use of a hinge 120 and is provided with a hasp 124, or other locking device. In the illustrated embodiment, the top plate 100 is provided with several rectangular slots 102, illustrated in more detail in FIG. 3 to receive the hasp 124 and allow for use of a padlock. The use of multiple slots 102 is optional, however the multiple slots 102 provide advantages in allowing the locking unit to be used as a general securing device. A single slot can be provided when it is known that the locking unit is being used to hold a battery, or other specifically dimensioned article, in place. The vertical wall 106 has a length greater than the vertical wall 118 approximately equal to the thickness of the hasp plate 122. This allows the top plate 100 to be placed over the hasp plate 122 while remaining parallel to one another. If the top plate 100 and the hasp plate 122 do not remain parallel, the hasp 124 is unable to fit within the rectangular slots. The hasp 124 can be formed by either slicing or cutting through the stainless hasp plate 122 and then pressing the metal within the slits, upwards to form the hasp 124. Alternatively, a separate piece of stainless steel can be welded to the hasp plate 122. The hasp can be a half circle, or any other configuration which will receive a locking device.

The hinge 120 is required when the battery is maintained in a battery well. Hinges 108 and 116, however, can be eliminated when in a battery well type situation as they would serve no value. Thus, the top plate 100 and hasp plate 122 are opened completely and the battery placed between the vertical walls 106 and 118 to rest on the base portions 114 and 112. In applications where the battery is in an open area, the hinge 120 could be eliminated. The hasp plate 122 and vertical wall 118 would be rigidly connected and would rotate at hinge 116. The hinge 104 is required since the top section 100 must have the ability to rotate over the hasp plate 122.

Figure 2:
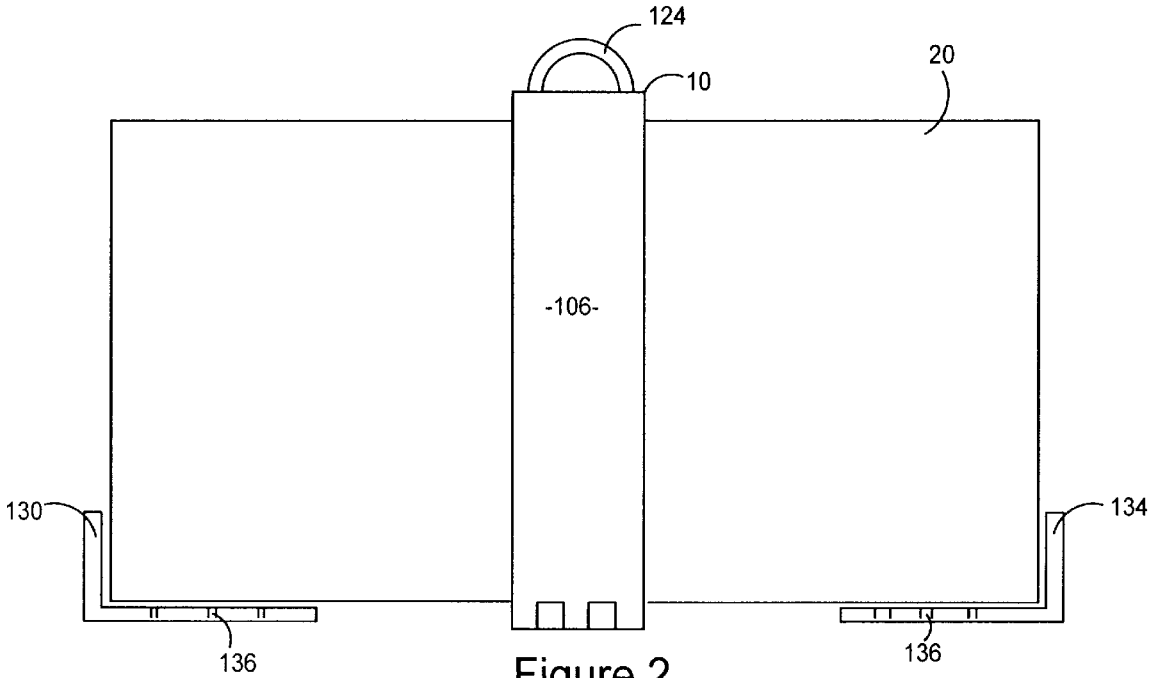
FIG. 2 is a side view of the securing mechanism of the present invention.

As can be seen from FIG. 2, the locking unit 10 encompasses either the length or width of the battery 20. For ease of discussion, further reference will be made to the locking unit 10 being encompassing the width of the battery 20, as illustrated. Thus, the locking unit 10 prevents vertical movement and side to side horizontal movement. When the battery 20 is stored in a well, the locking unit 10 is sufficient to prevent thief. However, if the battery 20, or other container, is stored in the open, additional securing must be used to prevent end to end horizontal movement. Two L-shaped locking members 130 and 134 are provided to lock the battery 20 into position. The L-shaped member 130 and 134 are secured directly to the boat through use of screw holes 136. The L-shaped members 130 and 134 do not require exact placement and slight movement can be allowed.

Figure 3:
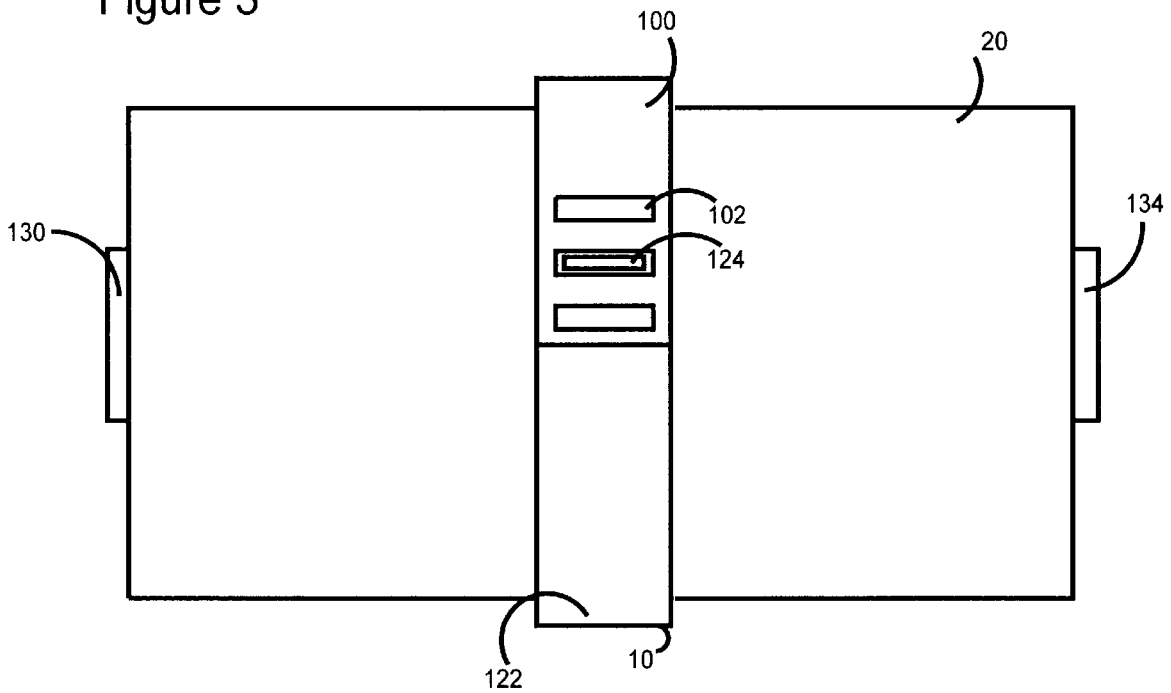
FIG. 3 is a top view of the securing mechanism of the present invention.

In FIG. 3 the battery 20 is installed and the top plate 100 placed over the hasp plate 122. Prior to installation of the battery, the L-shaped locking members 130 and 134 were placed at the appropriate distance and secured to the boat to prevent any horizontal, end to end movement. The dual base units 112 and 114 are spaced at approximately the width of the battery 20 and the locking unit 10 is secured to the boat at approximately the midpoint between the L-shaped locking members 130 and 134. The vertical walls 106 and 118 of the locking unit 10 should be firm against the walls of the battery. Rubber or other cushioning member can be used to provide the required firm contact, prevent scratching and allow for a slight "give". The cover from the battery box can easily be used as a template since it is slightly larger than the base of the battery box. The hasp plate 122 is closed first and the top plate 100 then closed. The hasp 124 is placed within the appropriately placed rectangular slot 102 and a padlock (not shown), or other locking device, placed in the hasp 124 to prevent the top plate 100 from being opened.

Figure 4:
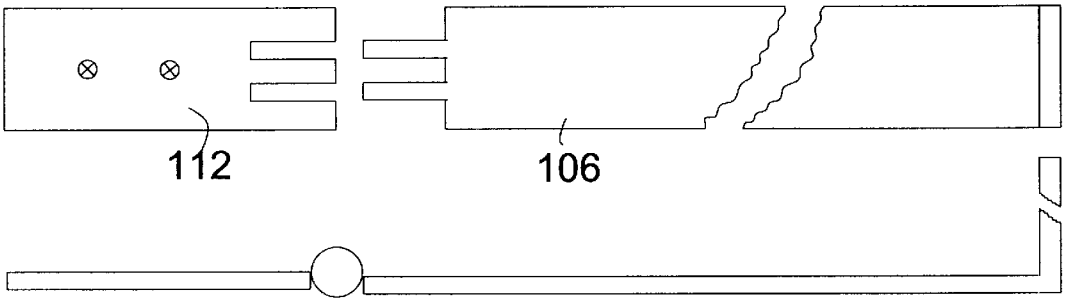
FIG. 4 is a top view of one embodiment of hinges for use with the instant invention.
Figure 5:
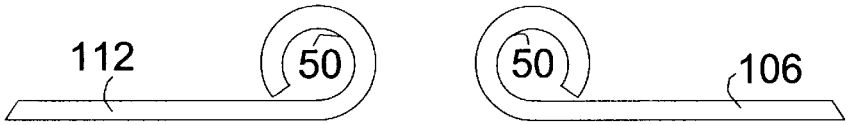
FIG. 5 is a side view of the hinges of FIG. 4.

The preferred hinge construction is illustrated in FIGS. 4 and 5. In this configuration, the edge of base unit 112 and the wall 106 are manufactured in tongue and groove with the edges rolled to form pin receiving areas 50. To assemble the locking unit 10, the base unit 112 is fitted with the wall 106 until the pin receiving areas 50 are aligned. A pin (not shown) is then inserted and secured through means known in the art. The pins are preferably also formed of stainless steel. Alternatively, the hinges can be formed by welding hinge sections to the various plates. Other methods of forming the hinges can be used as will become apparent to those skilled in the art.

To allow for greater height variation, the top plate 100 and hasp plate 122 can be provided with a spacer or spaced to accommodate varied container heights and to provide firm contact with the container upper surface. The spacers can be rubber or other cushioning material or they can be "U"-shaped members with the upper legs holding the spacer in place.

Preferably the component parts are about 1.5 inches wide, although these dimensions can be increased or decreased based on end use. Preferably the screw holes are countersunk for #10 screws, although other sizes can be used. To ensure the required strength, at least #10 screws should be used and, although larger sizes can be used, it is recommended that #10 be the minimum size utilized.

In an alternate embodiment, the securing mechanism is made from an electrically non-conductive plastic material. The plastic can be a composite material and can contain steel or other fibers for reinforcement to render the plastic more difficult to cut. The material can be a polyethylene, polypropylene or other synthetic polymer, such as high density polyethylene for added strength. The critical features of the plastic must include resistance to breakage over a wide temperature range, approximately −50 to +150 degrees F., and ultraviolet degradation. Depending upon the type and thickness of the material, the flexibility of the plastic can be used to provide the required hinging action.

Figure 6:
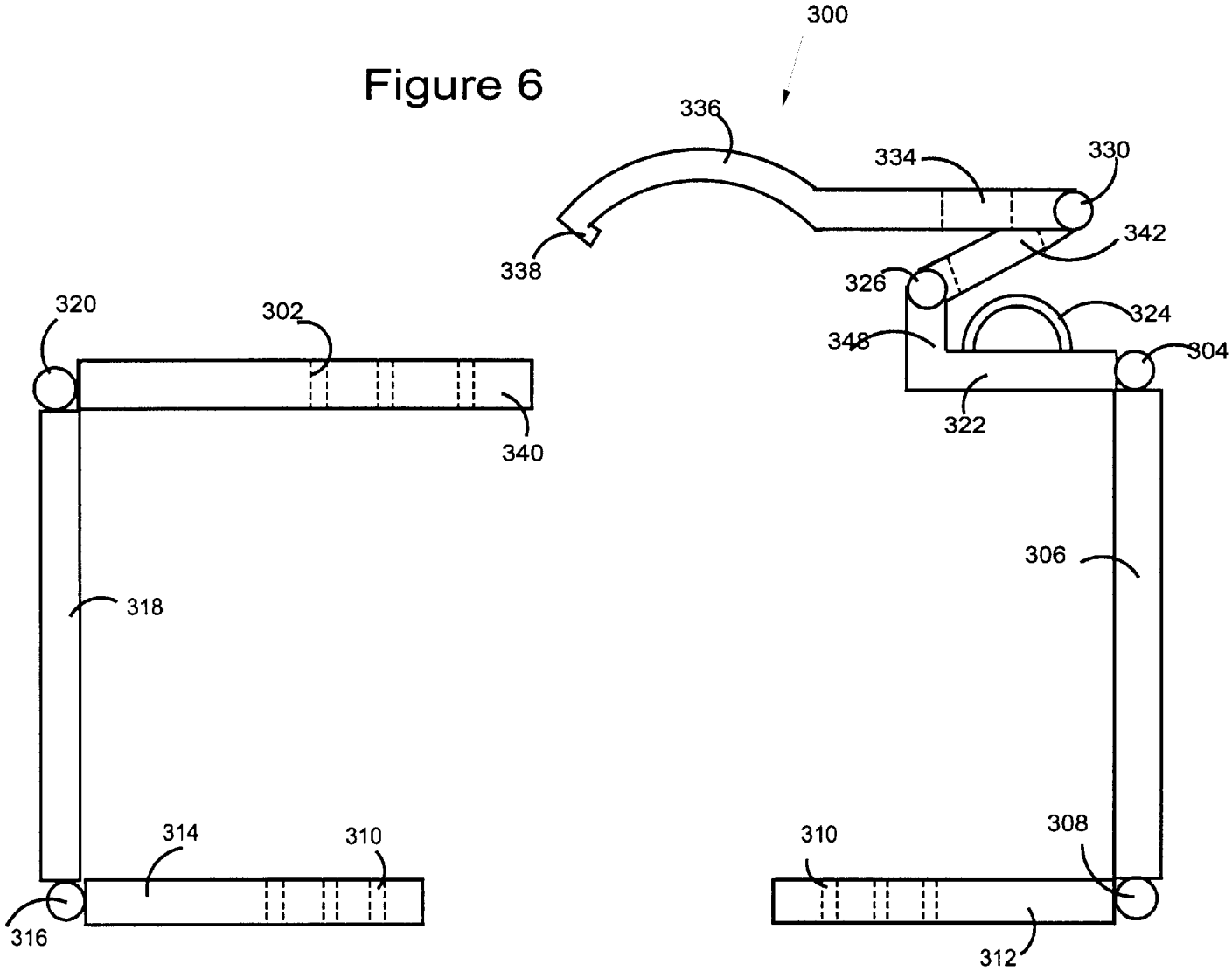
FIG. 6 is a side view of the instant invention designed to be manufactured in plastic.

The plastic locking unit 300 of FIG. 6 uses basically the same design as the locking unit 10, with the exception of an alternate locking mechanism. The battery (not shown) is prevented from end to end horizontal movement through use of L-shaped members, as described heretofore. These members can be manufactured from a high density plastic or metal, as previously described. As with the locking unit 10, the hinge 320 (120 of FIG. 1) can be eliminated when the battery is sufficiently exposed allow the vertical wall 318 to rotate at hinge 316. In the plastic locking unit 300, the hinge 320 can also be eliminated when the plastic provides sufficient flexibility to allow for insertion of the battery.

As shown in FIG. 6, the plastic locking unit illustrated generally as 300, consists of dual base units 312 and 314 attached to their respective vertical walls 306 and 318 through use of hinges 308 and 316. The base units 312 and 314 include screw holes 310 for attachment to the boat. The hinges 308, 304, 316 and 320 can be any of the designs described heretofore and known in the art. The vertical walls 306 and 318 are connected, through use of hinges 304 and 320, to the top locking portion. The top locking plate 340 is hingeably attached to vertical wall 318 and is provided with multiple locking slits 302 spaced along the plate 340. The hasp plate 322 is hingeably connected to vertical wall 306 at one end and connected, through use of hinge 326, to locking arm 328. The hasp plate 322 is L shaped with the leg 348 carrying the hinge 326. Locking arm 328 is provided with a hasp pass through 342 which is dimensioned to allow the hasp 324 to pass through the pass through 342 without friction or binding. The locking arm 328 is connected to the extension arm 336 using hinge 330. The J-shaped extension arm 336 illustrated herein is straight adjacent the hinge 330 and curved adjacent the locking tab 338. The hasp receiving slot 334 is dimensioned to receive the hasp 324. The receiving slot 334 should be dimensioned to eliminate excessive movement while allowing the locking arm 328 to rest adjacent the hasp plate 322 and the extension arm 336 rest adjacent the locking arm 328. This configuration can be changed dependent upon manufacturing abilities, length of arm and material used. The locking tab 338 is dimensioned to fit in the appropriately distanced locking slit 302.

Figure 7:
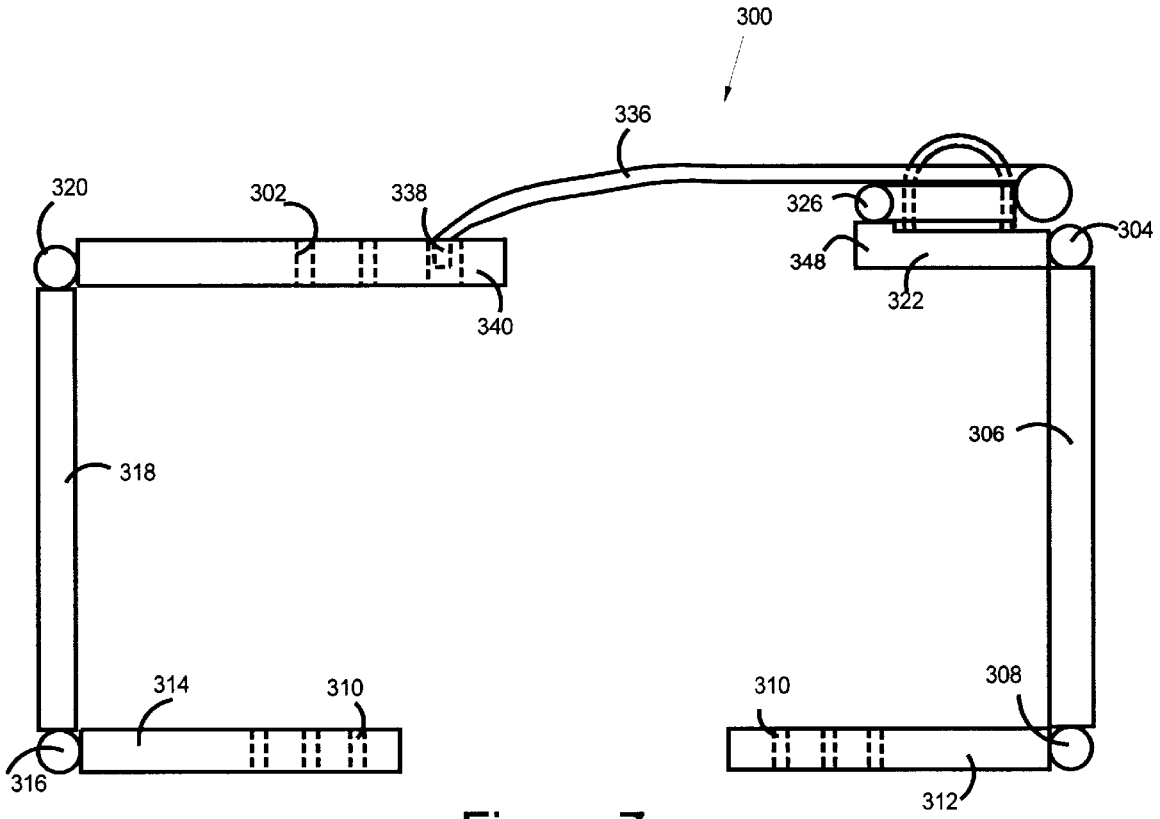
FIG. 7 is side view of the embodiment of FIG. 6 in the closed position.

To lock the plastic locking unit 300, as illustrated in FIG. 7, the battery is placed in the secured locking unit 300 and the top locking plate 340 placed over the battery. The locking tab 338 is placed is the appropriate locking slit 302 and the extension arm 336 pressed downward proximate the hinge 330. The hasp 324 then passes through the hasp receiving slots 342 and 334, extending beyond the extension arm 336 a distance sufficient to allow for a padlock to be used. The leg 348 of the hasp plate 322 allows for the locking arm 328 and the extension arm 336 to be locked in the closed position without the use of a padlock or other locking means. To do this, the leg 348 must have a length sufficient to allow for the locking arm 328 to lie parallel with, and adjacent to, the hasp plate 322. This allows for the battery to be maintained in place independent of the locking means.

The hasp 324 can be formed by either slicing or cutting through the plastic hasp plate 322 and then pressing the plastic within the slits, upwards to form the hasp 324. Alternatively, a separate piece of stainless steel or plastic can be secured to the plastic hasp plate 322. In an additional modification, the half circle hasp 324 would be secured to a stainless steel plate positioned below the hasp plate 322, extending through a slot cut in the hasp plate 322. While the hinges can be formed as described in the case of metal members, in the case of plastics, living hinged, that is, self-hinges can be used.

In the manufacturing of the elements, the dual base units 314 and 312 and the vertical walls 318 and 306 are mirror images, therefore cutting molding costs. Where the sections are formed by extrusion, the costs can be minimized by using a minimum number of extrusion dies. The member 322 must be independently formed due to its unique raised "L" portion adjacent hinge 326.

Although a hasp and padlock combination are used to lock the disclosed locking units, other means can also be used. These would include, but not be limited to, combination or key snap locks, such as used on luggage or electronic locks as used on automobiles. Further, the tension lock illustrated in combination with the plastic embodiment can also be incorporated with the metal embodiment of FIG. 1.

Figure 8:
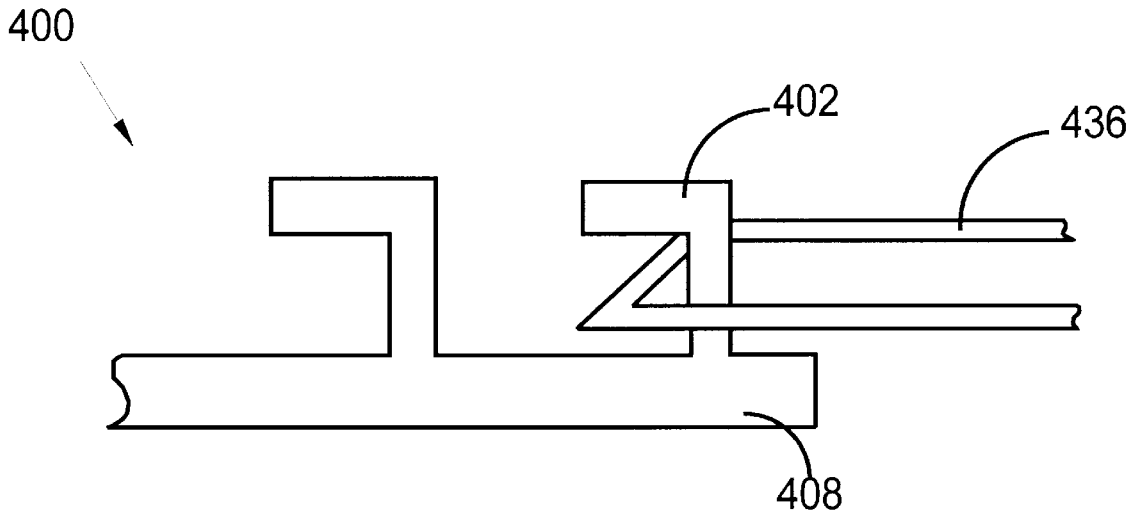
FIG. 8 is a perspective view of an alternate locking device.

An example of an alternate locking device is illustrated in FIG. 8 wherein the tab lock 400 replaces the slits 302 of FIGS. 6 and 7 with L-tabs 402. The L-tabs 402 are preferably integral to the top plate 408, although they can be subsequently added by welding or other means known in the art. The locking tab 338 and extension arm 336 has been replaced with locking loop 436. Although it is possible to manufacture this embodiment from plastic, it is recommended that the locking loop 436 be manufactured from metal to prevent theft. The L-tab 402 must have either an L or curved configuration to prevent the locking loop 436 from being pried off the tab.

Figure 9:
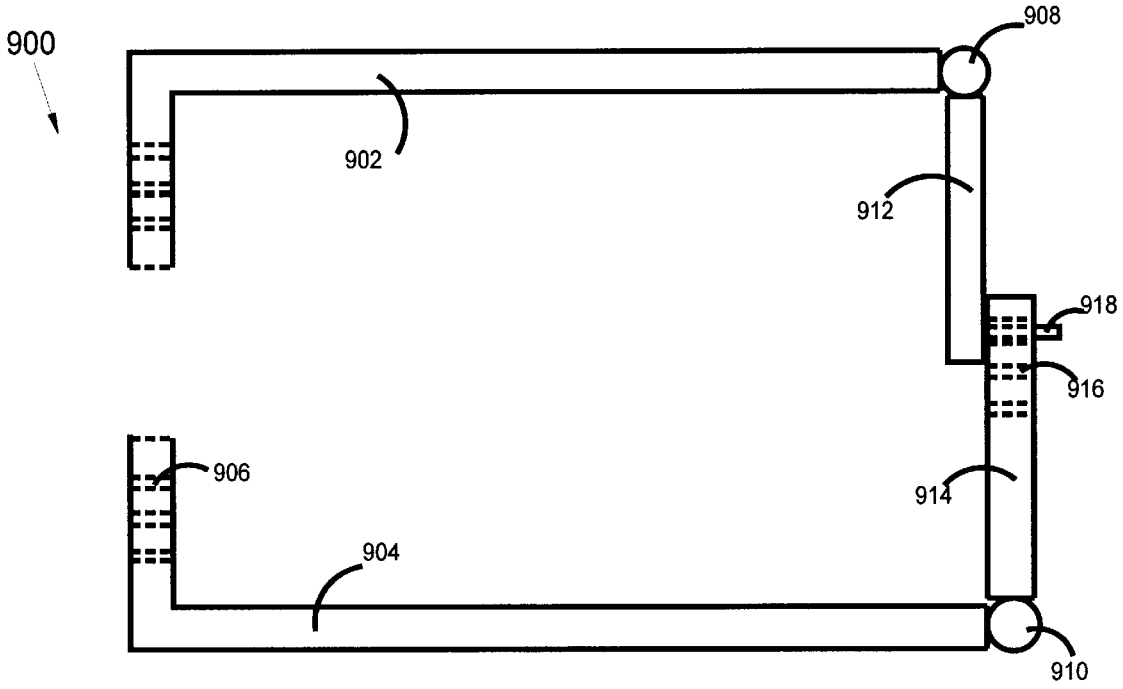
FIG. 9 is a side view of another embodiment incorporating a side access locking unit.

An alternate embodiment is illustrated in FIG. 9 in which the side access locking unit 900 is formed of dual braces 902 and 904. The legs of the rigid L-shaped braces 902 and 904 are provided with screw receiving holes 906 which are used to secure the unit 900 to the support structure. The brace 902 is connected to the hasp plate 912 through use of a hinge 908. The brace 904 is, in turn, connected to top plate 914 through use of hinge 910. The top plate 914 is provided with hasp receiving channels 916 dimensioned to receive the hasp 918. The side access locking unit 900 is designed, and operates, basically the same as the foregoing embodiments. The side access allows for the elimination of the equivalent of hinges 108 and 116. The hasp 918 would be secured through means as described above. The side installation would allow for items to be secured under seats, shelves, etc. Although not illustrated, the side access can also be incorporated with the floor mounting as illustrated in FIG. 1. The side access embodiment can be manufactured with either metal or plastic and can incorporate any of the various locks, brackets, etc. disclosed heretofore.

Figure 10:
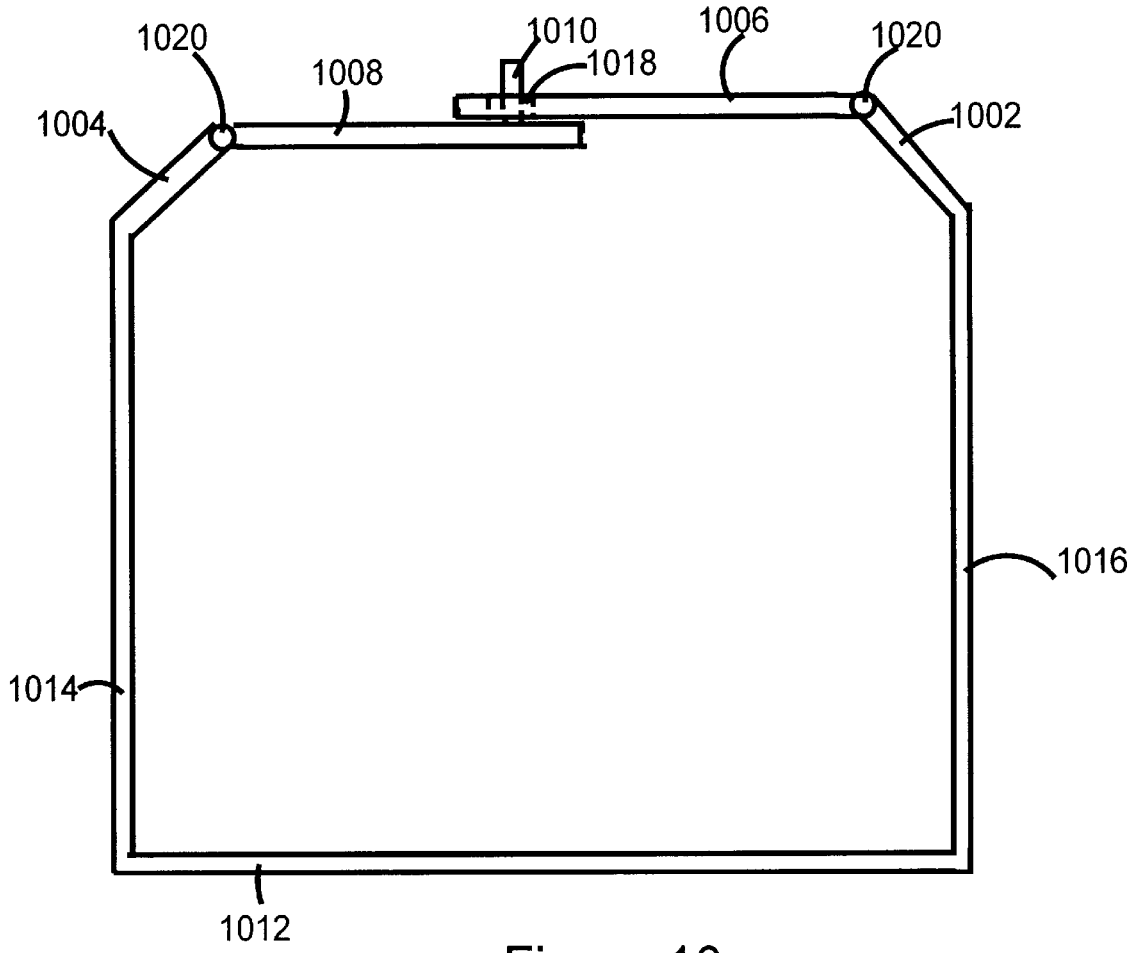
FIG. 10 is a side view of a chamfered embodiment of the locking device.

In FIG. 10 the locking unit 1000 has been designed to configure to the shape of a chamfered battery or battery box. The base 1012 is dimensioned to be slightly larger than the width of the battery to allow the interior of the unit to fit snugly around the exterior of the battery. The horizontal sides 1014 and 1016 lie approximate the exterior of the battery, angling in at angled braces 1002 and 1004 to conform to the design of a container, such a battery box. The horizontal sides 1014 and 1016 are hingeably connected to the base 1012 through use of hinges 1022. The hinges 1022 allow the horizontal sides 1014 and 1016 to open a sufficient distance to place the container into the locking unit 1000. The locking arms 1008 and 1006 are preferably hinged, using hinges 1020, at the connections between the angled braces 1002 and 1004. The hinges 1020 make the unit easier to close and lock, however in some embodiments it may be advantageous to omit one or both of these hinges 1020. As previously described, the locking arm 1008 is provided with locking means 1010, such as a hasp, which interlocks with the receiving means 1018. To utilize the disclosed locking arrangement which allows the locking arm 1006 to overlap the locking arm 1008, the angled brace 1002 must be slightly longer than the angled brace 1004 to provide the necessary clearance. This embodiment is advantageous for use with standard marine batteries as the design further inhibits theft.

The illustrated designs can be adapted for maintaining either interior or exterior batteries, or containers, by altering the dimensions and configuration of the disclosed locking units. As previously described, rubber bumpers or "U"-shaped spacers can be used to enable the securing mechanism to be readily adapted to various sized containers and, if necessary, batteries and/or battery cases.

The base, side and locking members can be formed from plastic by extruding sections having an elongated flat section and a circular end or ends. The ends can be slotted and/or drilled, after extrusion, to form the hinge configuration.

The battery lock can be secured through use of stainless steel bolts, using a non-corrosive material for the backing plates. Four small pieces of aluminum or stainless steel and 8 #10 stainless bolts, with washers and nuts, are used to bolt the "L" legs and locking unit in place. Most advantageously, and particularly where metal members are used, the battery is housed within a plastic or other non-conductive container. Preferably, the container is water resistant. The base members in all embodiments are positioned to firmly receive the battery or battery housing. The side walls of the battery or battery housing should be firm against the vertical members of the securing device. Rubber or other cushioning member can be used to provide the required firm contact. The cover from the battery box can be used as a template since it is larger than the base of the battery box.

The top locking plates 100 and 340 as well as hasp plates 122 and 322 can be provided with a spacer or spaced to accommodate varied battery heights and to provide firm contact with the battery or battery housing upper surface. The spacers can be rubber or other cushioning material or they can be "U"-shaped members with the upper legs holding the spacer in place. Alternatively, screws are used in place of bolts referenced herein. Silicone or other sealant should be used around each screw, or bolt, to prevent possible leakage.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A locking device for maintaining an object in a stationary position in relation to a structure, comprising in combination an object and a locking device, said object having at least three pairs of opposing parallel surfaces, said locking device having:

a pair of base units, each of said base units having securing means, said securing means independently securing each of said base units, at a user defined location, to said structure, said base units contacting said object proximate a midpoint of a first surface of a first pair of said at least three pairs of opposing parallel surfaces;

a pair of parallel, opposing, side units, each of said side units being at approximately right angles to, and affixed to, one of said base units to prevent lateral movement in a first direction;

a pair of top locking plates, said locking plates being at approximately right angles to said side units, a first of said locking plates overlapping a second of said locking plates;

adjustable locking means, said locking means locking said first locking plate to said second locking plate at a user selected point to maintain said object in said stationary position;

at least one pair of hinge means;

whereby said pair of base units enables user adjustability of said locking device to said object's individual base size and said adjustable locking means enables adjustability of said locking device to said object's individual top size and prevent removal of said object from said locking device and said side units restrict movement of said object in a first direction.

2. The locking device of claim 1 further comprising a second pair of hinge means, said second pair of hinge means connecting each of said side units to said base units.

3. The locking device of claim 1 wherein said hinge means connect each of said pair of side units to said base units.

4. The locking device of claim 1 wherein said first locking plate has multiple receiving areas to provide adjustability to the angle between said side units and said base units.

5. The locking device of claim 1 further comprising a pair of opposing L-shaped locking brackets, each of said L-shaped locking brackets having securing means, said securing means being secured in a user determined position adjacent a first and a second surface of a third pair of said at least three pairs of opposing parallel surfaces, thereby preventing movement of said object in a second direction, said second direction being at 90 degrees from said first direction.

6. The locking device of claim 1 wherein said object is a battery.

7. The locking device of claim 1 wherein said object is within a container having at least four sides, said locking device thereby prevent vertical movement of said object.

8. The locking device of claim 1 wherein a first of said pair of side units has a length greater than a second of said pair of side units.

9. The locking device of claim 1 wherein said locking means is a hasp.

10. The locking device of claim 1 wherein said securing means are bolt receiving channels.

11. The locking device of claim 1 wherein said hinge means connect each of said pair of side units to said pair of top locking plates.

12. The locking device of claim 11 further comprising a second pair of hinge means, said second pair of hinge means connecting each of said side units to said base units.

13. The locking device of claim 1 wherein said hinge means connect each of said pair of side units to said base units.

14. A locking device for maintaining an object in a stationary position in relation to a structure, comprising in combination an object and a locking device, said object having at least three pairs of opposing parallel surfaces, said locking device having:

a pair of base units, each of said base units having securing means, said securing means independently securing each of said base units, at a user defined location, to said structure, said base units contacting said object proximate a midpoint of a first surface of a first pair of at least three pairs of opposing parallel surfaces, a pair of parallel, opposing, side units, each of said side units being at approximately right angles to, and affixed to, one of said base units to prevent lateral movement in a first direction;

a pair of top locking plates, each of said locking plates being at approximately right angles to said side units, a first of said locking plates overlapping a second of said locking plates, adjustable locking means, said first locking means locking said first locking plate to said second locking plate at a user point selected to maintain said object in said stationary position;

at least one pair of hinge means, said at least one pair of hinge means connecting each of said pair of side units to said pair of top locking plates;

a pair of opposing L-shaped locking brackets, each of said L-shaped locking brackets having securing means, said securing means being secured in a user determined position adjacent said object at a first and a second surface of a third pair of said at least three pairs of opposing parallel surfaces and preventing movement of said object in a second direction, said second direction being at 90 degrees from said first direction;

whereby said pair of base units enables user adjustability of said locking device to said first surface of said first of said at least three pairs of opposing parallel surfaces and said adjustable locking means enables adjustability of said locking device to a second of said first of said at least three pairs of opposing parallel surfaces, said locking means preventing vertical removal of said object and said side units and L-brackets restricting horizontal movement of said object.

15. A method of securing an object having at least three pairs of opposing parallel surfaces in a stationary position onto a structure to restrict lateral movement in a first direction and prevent vertical removal of said object using a locking device having:

a pair of base units, each of said base units having securing means, said securing means independently securing each of said base units to said structure, said base units contacting said object proximate a midpoint of a first of a first pair of said at least three pairs of opposing parallel surfaces;

a pair of parallel, opposing, side units, each of said side units being at approximately right angles to, and affixed to, one of said base units to prevent lateral movement in a first direction;

a pair of top locking plates, said locking plates being at approximately right angles to said pair of side units, a first of said locking plates overlapping a second of said locking plates;

adjustable locking means, said locking means locking said first locking plate to said second locking plate at a user selected point to maintain said object in said stationary position;

at least one pair of hinge means connecting each of said pair of side units to said pair of top locking plates;

comprising the steps of:

measuring distance between a second pair of opposing parallel surfaces;

placing a first of said pair of base units to align a first of said pair of side units proximate a first surface of said second pair of surfaces;

securing said first base unit to said structure;

placing a second of said pair of base units to align a second of said pair of side units proximate a second surface of said second pair of surfaces;

securing said second base unit to said structure;

positioning said side units adjacent a first and second surface of said second of said at least three pairs of opposing parallel surfaces;

placing said top locking plates adjacent a second surface of said first of said at least three pairs of opposing parallel surfaces;

locking said locking plates in a position appropriate to maintain said side units adjacent a first and second surface of said second of said at least three pairs of opposing parallel surfaces.

16. The method of claim 15 preventing further movement of said object by securing a pair of opposing L-shaped locking brackets to said structure in a position to place said L-shaped locking brackets proximate a first and second surface of a third pair of opposing parallel surfaces, said L-shaped locking brackets preventing movement of said object in a second direction, said second direction being at a 90 degree from said first direction.

* * * * *